US008113896B2

(12) United States Patent
Wang et al.

(10) Patent No.: US 8,113,896 B2
(45) Date of Patent: Feb. 14, 2012

(54) AQUATIC CARRIER AND RUDDER THEREOF

(75) Inventors: Dave Wang, Taipei County (TW); Angela Lu, Taipei County (TW); Christine Wang, Taipei County (TW); John Wang, Taipei County (TW)

(73) Assignee: Grandot Tech. Incorporated, Taipei County (TW)

( * ) Notice: Subject to any disclaimer, the term of this patent is extended or adjusted under 35 U.S.C. 154(b) by 66 days.

(21) Appl. No.: 12/748,658

(22) Filed: Mar. 29, 2010

(65) Prior Publication Data

US 2010/0248566 A1 Sep. 30, 2010

(30) Foreign Application Priority Data

Mar. 27, 2009 (TW) ..... 98110208 A
Mar. 26, 2010 (TW) ..... 99109243 A

(51) Int. Cl.
*B63B 35/79* (2006.01)

(52) U.S. Cl. ..... 441/79

(58) Field of Classification Search ..... 441/79; 114/162, 127–141
See application file for complete search history.

(56) References Cited

U.S. PATENT DOCUMENTS 3,087,173 A * 4/1963 Meyer ..... 441/79

* cited by examiner

*Primary Examiner* — Edwin Swinehart
(74) *Attorney, Agent, or Firm* — Rabin & Berdo, P.C.

(57) ABSTRACT

A fin of aquatic carrier is described, which includes a fixing component, a retractable component, and a first elastic component. The retractable component is pivoted to the fixing component; the first elastic component connects the fixing component and the retractable component and supports the retractable component. When the retractable component experiences an external force, the first elastic component is compressed and causes the retractable component to rotate with respect to the fixing component. When surfers or swimmers are hit by the fin of aquatic carrier described in this invention, the rotation of the retractable component with respect to the fixing component reduces the force exerted on them, thus preventing them from being hurt. In addition, an aquatic carrier with a fin is also described.

12 Claims, 11 Drawing Sheets

AQUATIC CARRIER AND RUDDER THEREOF

CROSS-REFERENCES TO RELATED APPLICATIONS

This non-provisional application claims priorities under 35 U.S.C. §119(a) on Patent Application No. 98110208 and 99109243 filed in Taiwan, R.O.C. on 2009 Mar. 27 and 2010 Mar. 26, the entire contents of which are hereby incorporated by reference.

BACKGROUND OF THE INVENTION

1. Technical Field

The present invention relates to a fin of aquatic carrier, and more particularly to a fin of aquatic carrier that can absorb impact. The present invention also relates to an aquatic carrier which has the fin that can absorb impact.

2. Background

Aquatic activities, especially surfing, have been very popular all over the world. Most surfboard fins are made from fiber reinforced plastics (FRP), such as glass fiber reinforced plastics. In order to reduce the dragging force of water during surfing, the edges of fins are modified so as to be extremely sharp. An impact between the fins and human bodies therefore, usually results in serious injuries.

Please refer to FIG. 1, in which the conventional aquatic carrier 1 such as the surfboard, consists of a carrier component 10 and a fin 11. The customary fin 11 is one piece and fixed onto the carrier component 10. If the stiff fin 11 hits someone doing aquatic activities, the sharp edge will slash their clothes and skin, causing unexpected injuries. Efforts have been made to modify the fin's shape, dimension, sharpness and thickness. However, all of those improvements are focused on providing better performance in different wave conditions rather than preventing people from being injured.

In addition, a fin 11 which can be withdrawn into the carrier component 10 has been proposed for easy carry. In this case, the fin 11 still must be drawn out and fixed before the user starts surfing. Thus this likewise does not ensure safety.

Accordingly, the primary issue in need of a solution is to improve the structure of the fin of the aquatic carrier, in order to protect people being injured.

SUMMARY

In view of the problem, this invention presents a fin of aquatic carrier including: a fixing component, a retractable component pivoted to the fixing component, and a first elastic component connected to the fixing component and the retracted component, as well as supporting the retractable component by elastic force.

In addition, this invention also presents an aquatic carrier including: a carrier, a fixing component connecting to the carrier, a retractable component pivoted to the fixing component, and a first elastic which is connected to the fixing component and the retraced component as well as supporting the retractable component by a tension force. The retractable component compresses the first elastic component, and rotates with respect to the fixing component when experiencing external force.

One feature of this invention is that the fin includes a fixing component and a retractable component, making the retractable component capable of rotating with respect to the fixing component. When the fin described in this invention hits someone or the user themselves due to overturning of the aquatic carrier, the impact force is reduced by the rotation of the retractable component with respect to the fixing component. As a result, an injury which could be caused is prevented, and the risk of damage to the fin is reduced. Another feature of this invention is that the fin can recover to the original condition immediately after the aquatic carrier passes through the point of impact or the external force no longer exists. Accordingly, the fin can keep functioning immediately after collision, making the aquatic carrier return promptly to its original status.

This invention therefore solves the problem that people are easily injured by the conventional aquatic carrier and fin. The preferred embodiments and effects related to the present invention will be described in detail with the following figures.

BRIEF DESCRIPTION OF THE DRAWINGS

The following detailed description of the embodiments of the present invention can best be understood when read in conjunction with the following drawings, in which device parts are identified with reference numerals and in which.

DETAILED DESCRIPTION

Figure 1:
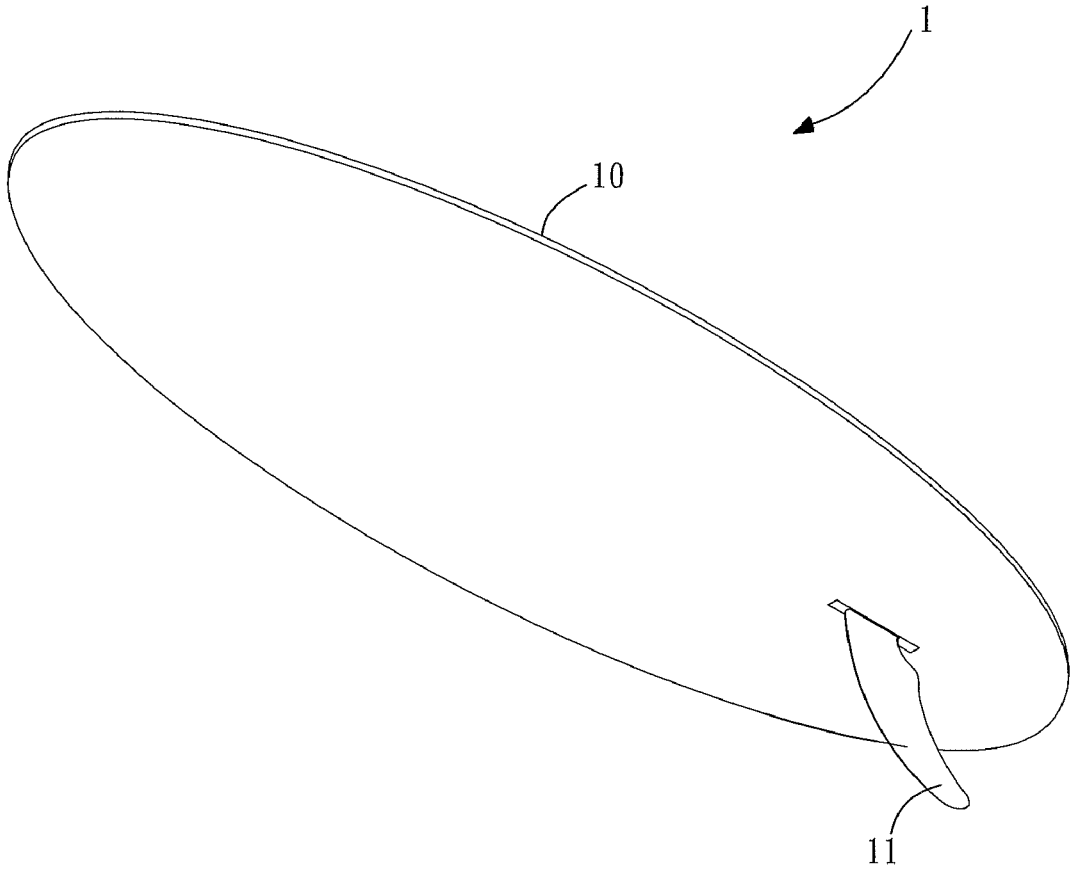
FIG. 1 Prior Art
FIG. 1 is a perspective diagram of the prior art.
Figure 2A:
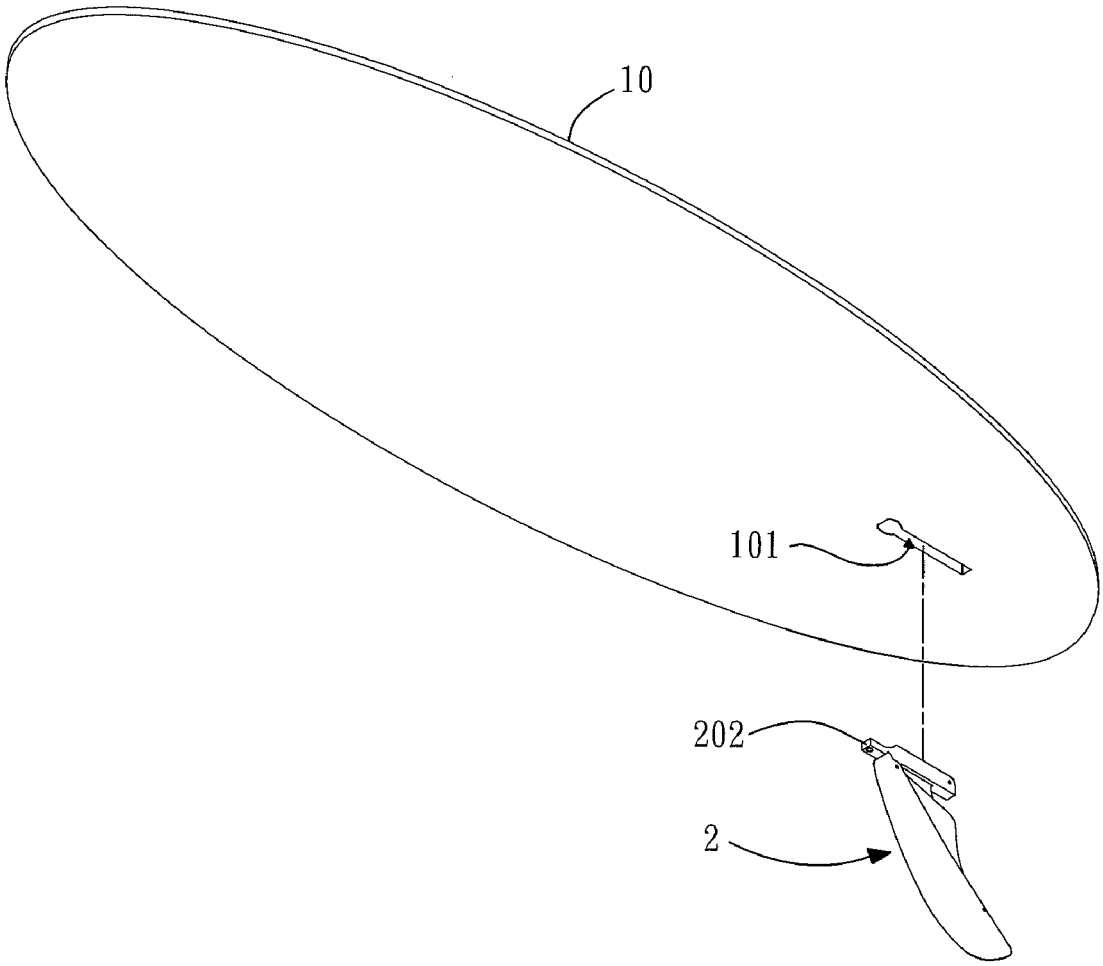
FIG. 2A is a perspective diagram of the first embodiment, illustrating the connection between the fin and the aquatic carrier.
Figure 2B:
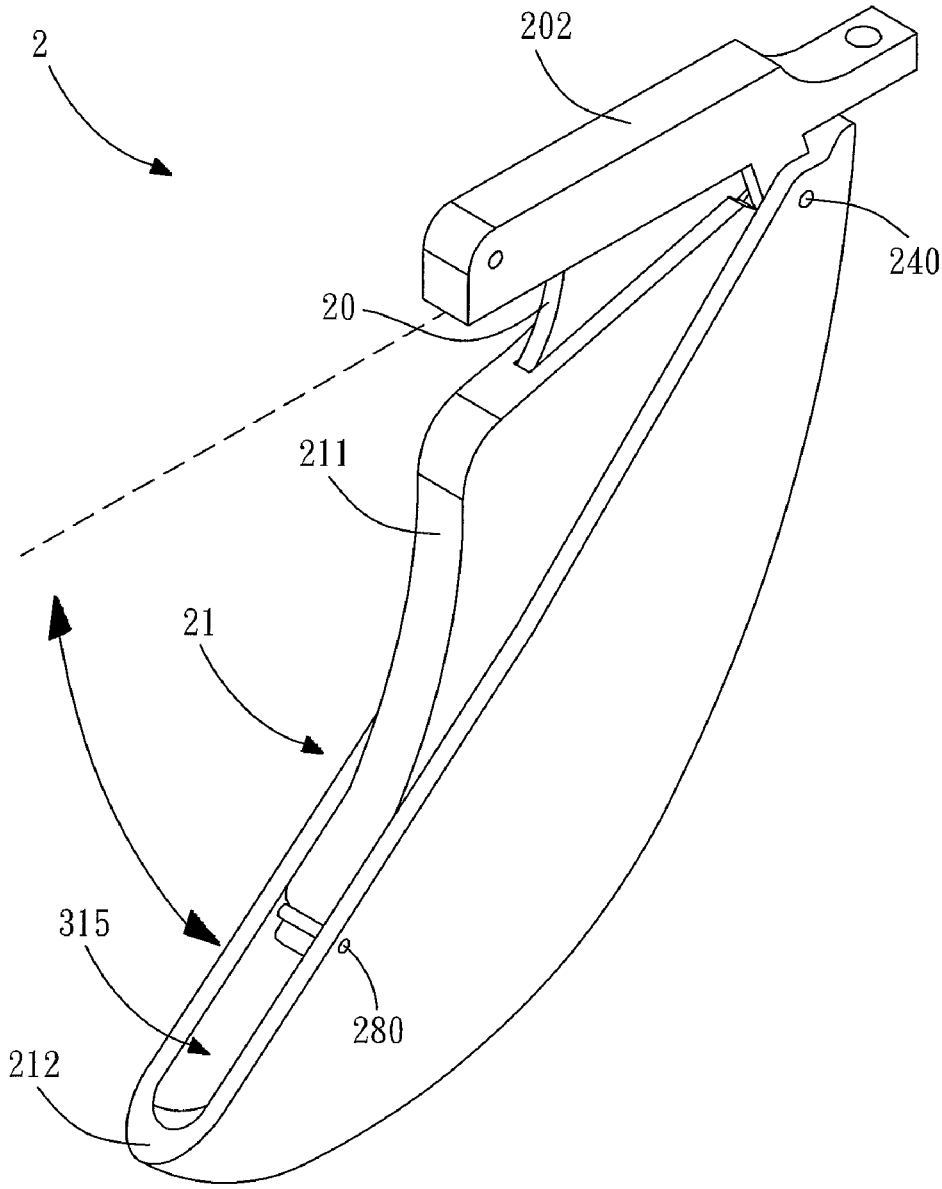
FIG. 2B is a perspective diagram of the fin of FIG. 2A.
Figure 2C:
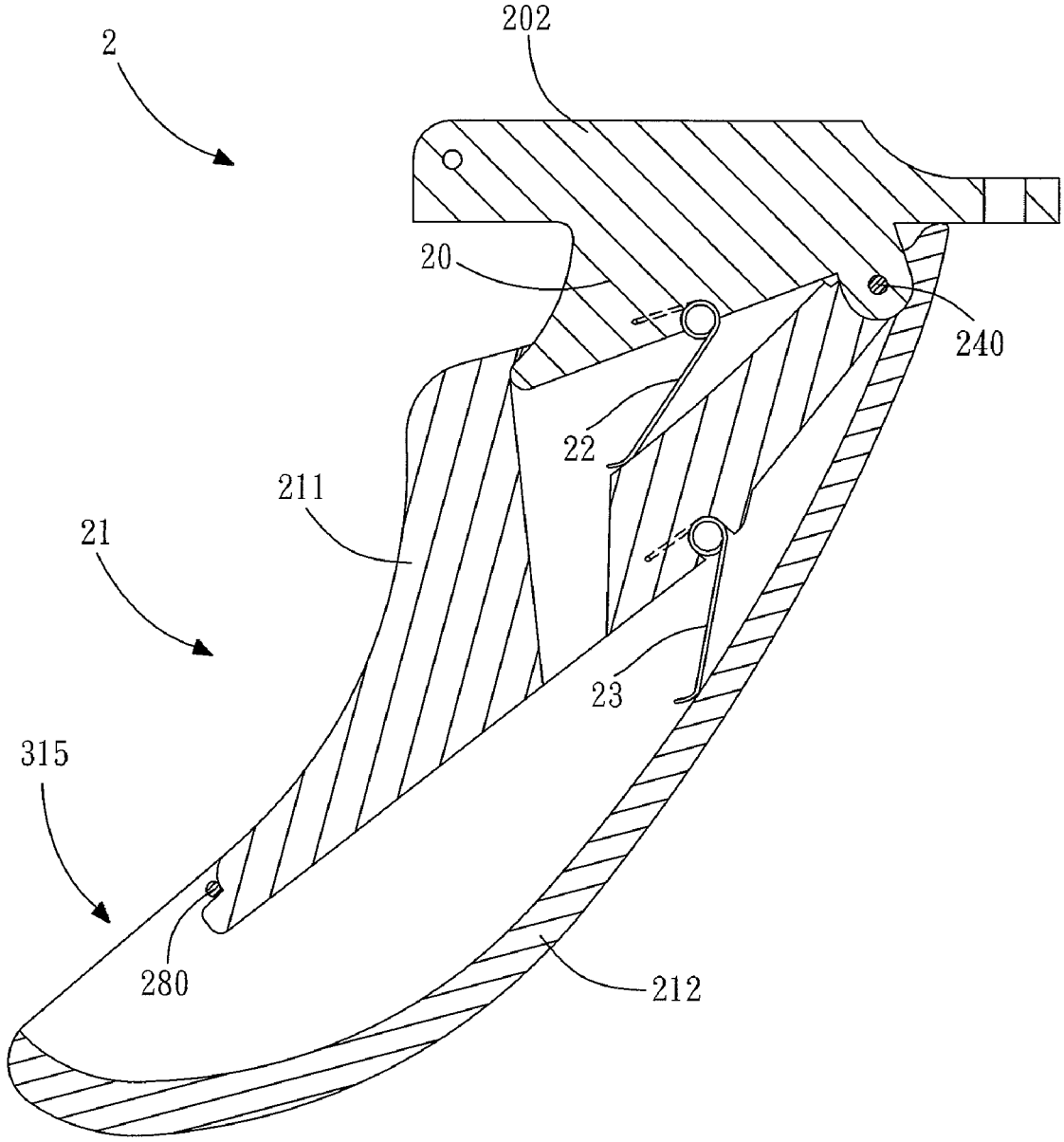
FIG. 2C is a sectional diagram of the fin of FIG. 2B.

Please refer to FIGS. 2A, 2B and 2C, illustrating an aquatic carrier and a fin according to the first (preferred) embodiment. The fin 2 of the aquatic carrier includes a fixing component 20, a retractable component 21, and a first elastic component 22. The fixing component 20 and the retractable component 21 are preferably produced by glass fiber reinforced plastics, though carbon fiber reinforced plastics or other fiber reinforced plastics are also practicable. However, it should be understood that the invention is not limited to the materials mentioned above.

In addition, the fixing component 20 has a fin base 202, and is fixed onto the fin fixture 101 of the aquatic carrier 1 via the fin base 202 by way of screwing, locking, clipping or embedding. In other case, it is also practicable to eliminate the fin base 202 and fix the fixing component 20 directly onto the fin fixture 101 of the aquatic carrier 1.

Figure 3A:
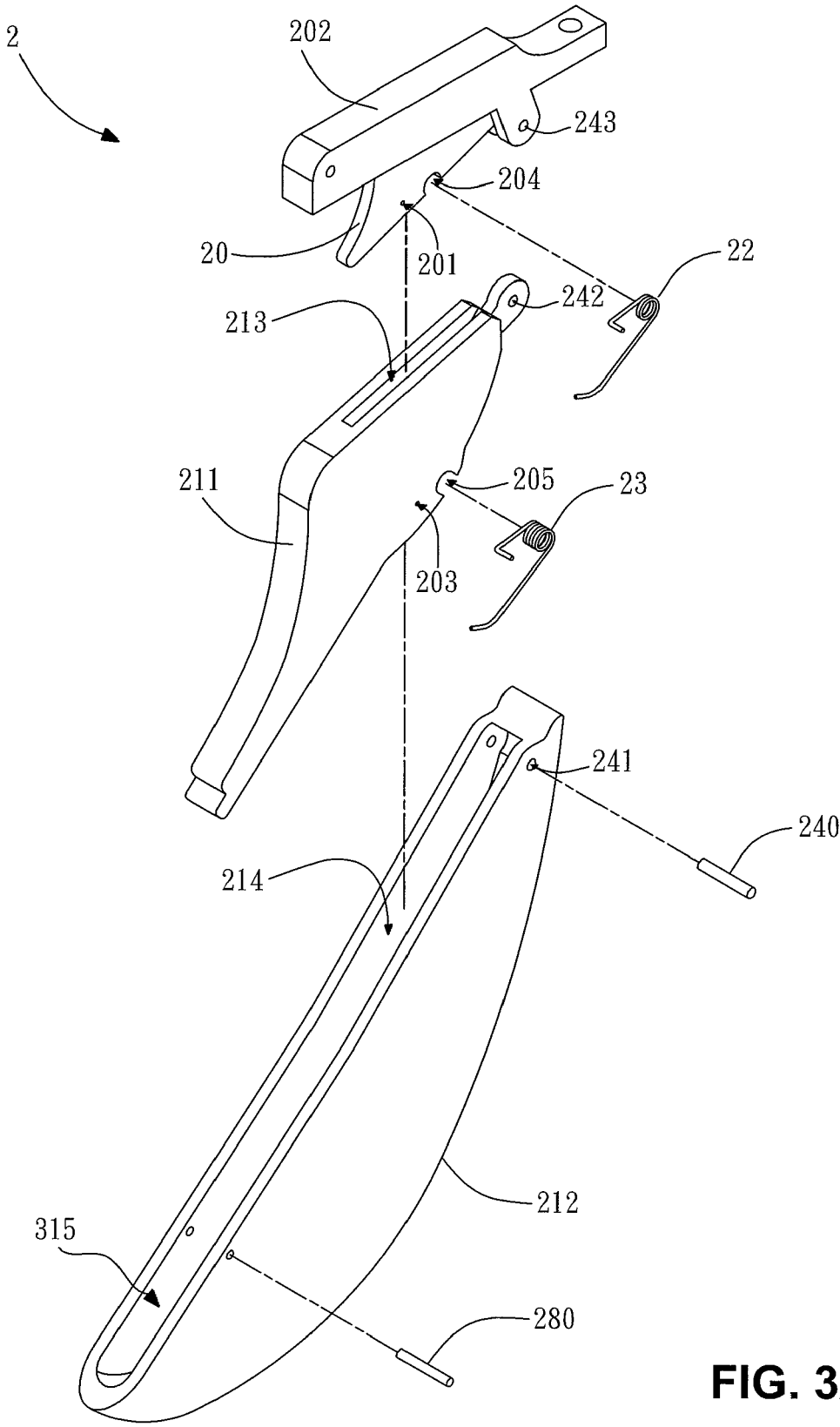
FIG. 3A is a first exploded perspective diagram of the fin according to FIG. 2A.
Figure 3B:
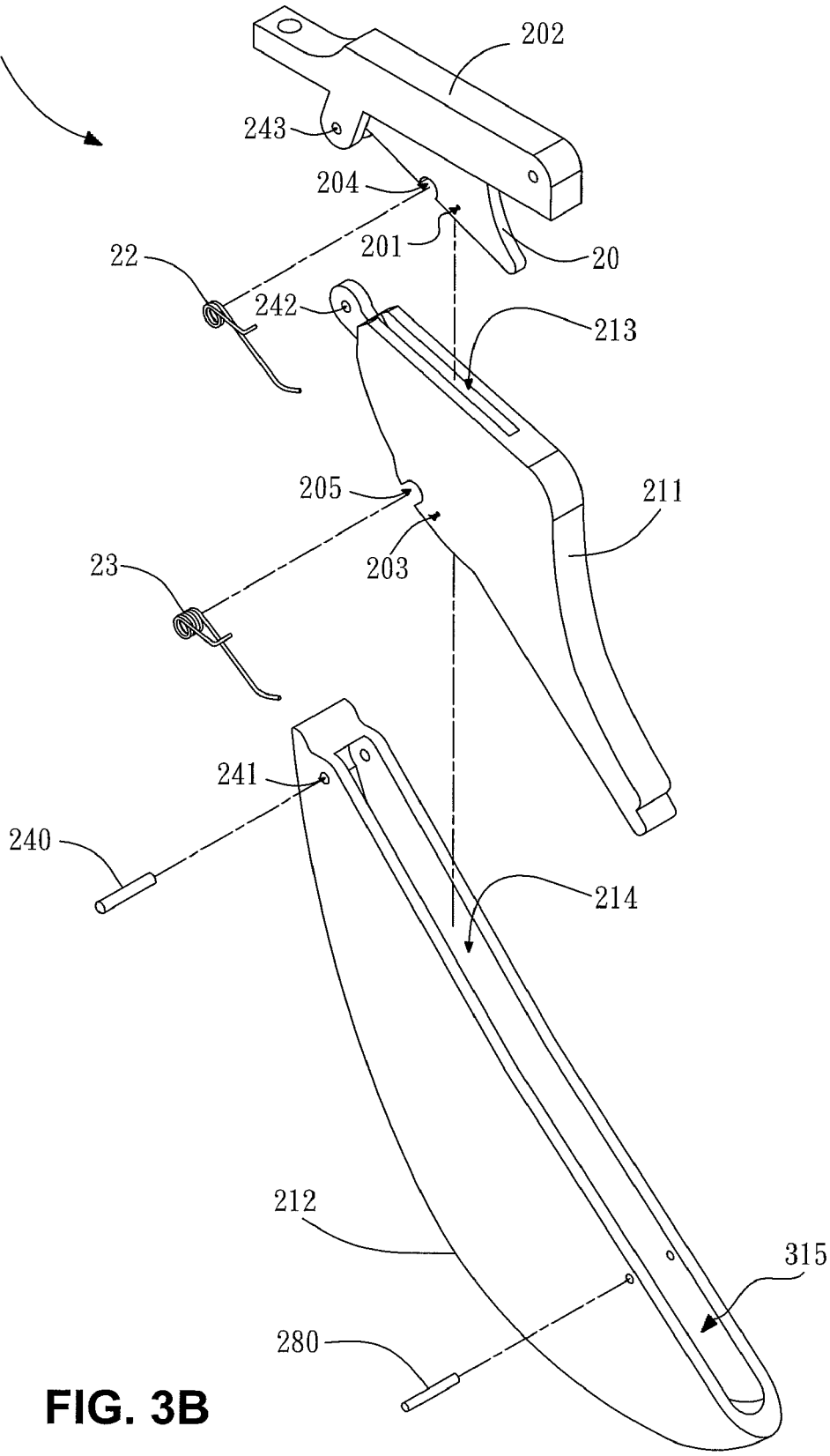
FIG. 3B is a second exploded perspective diagram of the fin according to FIG. 2A.
Figure 3C:
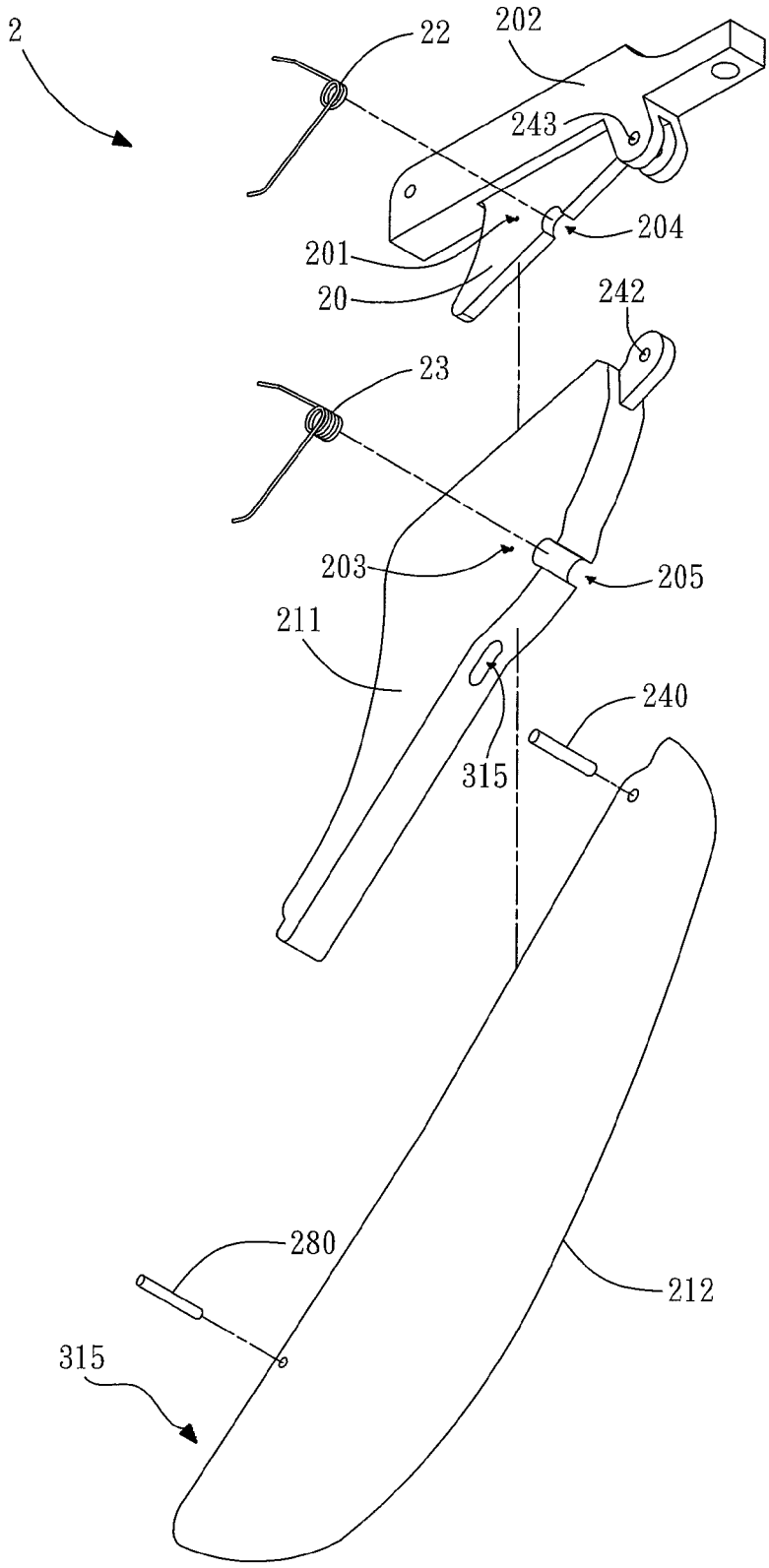
FIG. 3C is a third exploded perspective diagram of the fin according to FIG. 2A.

Please refer to FIGS. 3A, 3B and 3C, which are the exploded perspective diagrams of the fin 2 from different angles of view. The first elastic component 22 is set at the first cavity 204 of the fixing component 20. One end of the first elastic component 22 is connected to the first elastic component fixing hole 201, and the other end is against the retractable component 21. In this embodiment, the first elastic component 22 is preferably a spring such as a compression spring, a V-shape spring, or a torsion spring. The retractable component 21 is against by the tension force of the first elastic component 22, which remains at a constant included angle between the fixing component 20 and the retractable component 21 on the premise that no external force exists.

In the first embodiment, the retractable component 21 is preferably composed of the first retractable plate 211, the second retractable plate 212 and the second elastic component 23. The first retractable plate 211 is pivoted to the fixing component 20; the second retractable plate 212 is pivoted to the first retractable plate 211; and the second elastic component 23 is set at the second cavity 205 of the first retractable plate 212. One end of the second elastic component 23 is connected to the second elastic component fixing hole 203 of the first retractable plate 211, and the other end is against the second retractable plate 212. The second elastic component 23 is preferably a spring such as a compression spring, a V-shape spring, or a torsion spring. The second retractable plate 212 is against by the tension force of the second elastic component 23, which remains at a constant included angle between the first retractable plate 211 and the second retractable plate 212.

The fixing component 20, the first retractable plate 211, and the second retractable plate 212 are pivoted together by a pivot 240 passing through the pivot hole 241, 242 and 243. The pivot 240 is primarily used to fix the fixing component 20, the first retractable plate 211, and the second retractable plate 212 at the same axis, making them can be folded or unfolded as a fan.

The pivot 240 can be a rivet, a screw or other safe and practicable replacement. The advantage of using the rivet as the pivot 240 is the low risk of separation of the pivoted components. However, as the pivot 240 becomes loose or comes off, a rivet tool is required to re-pivot the fixing component 20, the first retractable plate 211, and the second retractable plate 212 together. Using a screw as the pivot has the advantage that the pivoted components are easily separated, so that the sand accumulated in the first hollow part 213 and the second hollow part 214 is easy to be removed. After cleaning, the pivoted components are also easy to assemble. The only disadvantage of using a screw as the pivot 240 is the risk of pivot looseness, which could result in separation of the pivoted components.

The first retractable plate 211 of the retractable component 21 is held by the tension force of the first elastic component 22, which maintains a constant included angle between the fixing component 20 and the first retractable plate 211 on the premise that no external force exists. Further, the first retractable plate 211 has the first hollow part 213, and the second retractable plate 212 has the second hollow part 214. When the retractable component 21 experiences an external force (hitting something or someone), the second retractable plate 212 compresses the second elastic component 23, causing the first retractable plate 211 to become contained in the second hollow part 214. Provided the external force is not removed immediately, the first retractable plate 211 of the retractable component 21 will compress the first elastic component 22 as well, and cause the retractable component 21 to rotate with respect to the fixing component 20. Simultaneously, the fixing component 20 is contained in the first hollow part 213.

A drain hole 315 is arranged between the first hollow part 213 and the second hollow part 214. The drain hole 315 is used to drain water, sand or something which should not enter the first hollow part 213, ensuring the retractable components 21 can rotate smoothly with respect to the fixing component 20. In addition, another drain hole 315 which is also used to drain water, sand or something which should not enter the second hollow part 214 is arranged at the opening of the second hollow part 214. It is understood that the position of the drain hole 315 depends on the design requirements; the position of the drain hole 315 described in this embodiment is not used to limit this invention.

When the fin 2 described in the embodiment hits someone or something, some of the impact force can be absorbed spontaneously due to its retraction. People doing aquatic activities are therefore protected from harm, and the risk of damage to the fin 2 is reduced. Moreover, the fin 2 will recover and continuously function immediately after passing through the point of impact due to the elasticity of the first elastic component 22 and the second elastic component 23.

It is unnecessary for the retractable component 21 to have both the first retractable plate 211 and the second retractable plate 212. The primary characteristic of the invention is that the retractable component 21 is held by the first elastic component 22 as well as being able to rotate with respect to the fixing component 20 when experiencing external force. For instance, the retractable component 21 may have only the first retractable plate 211, without the second retractable plate 212. In addition, the retractable component 21 can also have a third retractable plate (not shown) pivoted to the second retractable plate 212, or have a fourth retractable plate (not shown) pivoted to the third retractable plate, and so forth. Thus the impact experienced by a human body or the fin 2 can be reduced to a minimum, and people and the fin 2 protected as a consequence.

When the fin 2 is installed on the carrier component 10, it must be fixed onto the fin fixture 101. If the fin 2 hits someone or something during surfing, the second elastic component 23 will be compressed by the second retractable plate 212; likewise, the first elastic component 22 will be compressed by the first retractable plate 211. On passing through the point of impact, the elastic force of the first elastic component 22 and the second elastic component 23 will push the first retractable plate 211 and the second retractable plate 212 back to the original position automatically. When a collision occurs between two objects, the impact force is determined by several factors, such as speed, rigidity of objects, impact angle etc. As long as one of the two objects is elastic, the harm to people or the fin 2 can be reduced. The reliability and safety of the invention are therefore increased.

Figure 4:
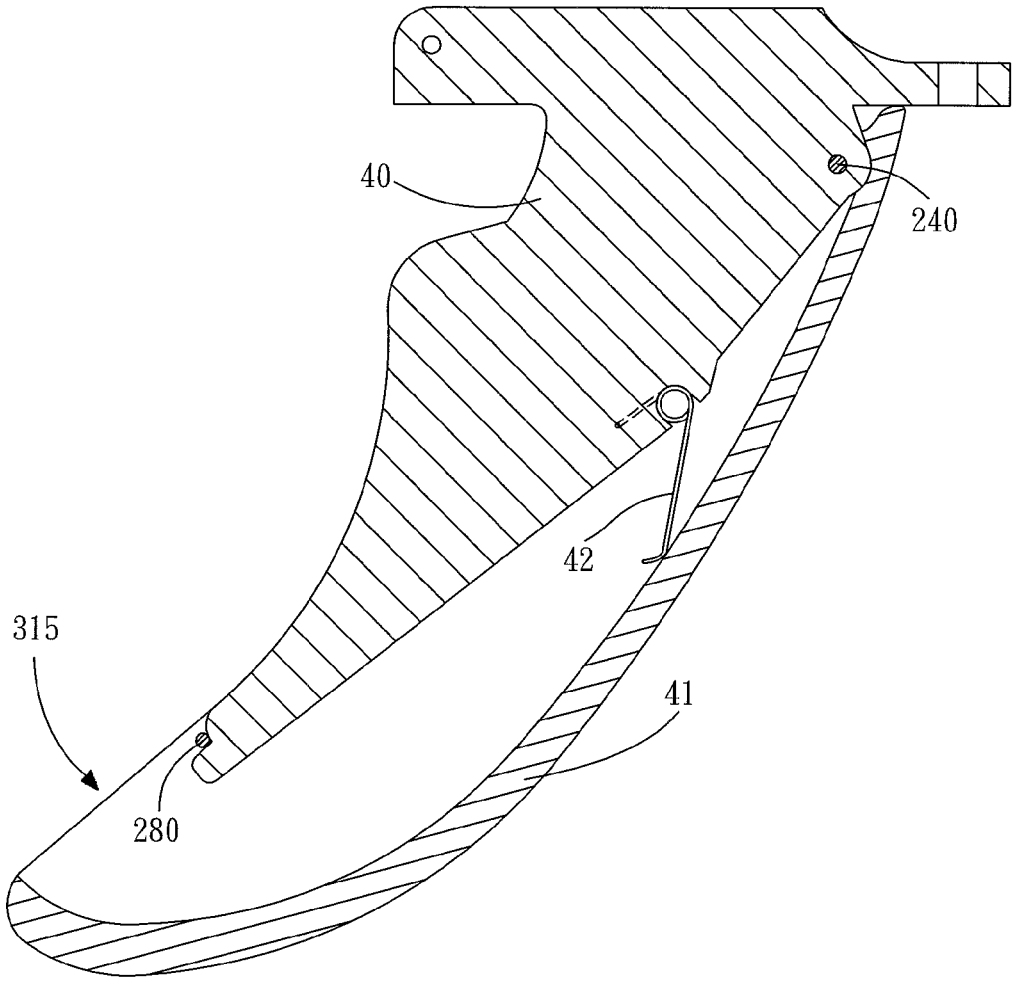
FIG. 4 is a sectional diagram the second embodiment.

Please refer to FIG. 4, which is the sectional diagram of the second embodiment of the invention. Rather than being composed of the first retractable plate 211 and the second retractable plate 212, the retractable component 41 in the second embodiment is one piece. When the retractable component 41 experiences an external force, the retractable component 41 compresses the first elastic component 42, making the retractable component 41 rotate with respect to the fixing component 40, so that the impact force is reduced and the human body and fin 2 are protected from harm. Moreover, the fin 2 will recover and continuously function immediately after passing through the point of impact due to the elasticity of the first elastic component 2. Consequently, the aquatic carrier on which the fin 2 is installed can keep its balance still.

Figure 5:
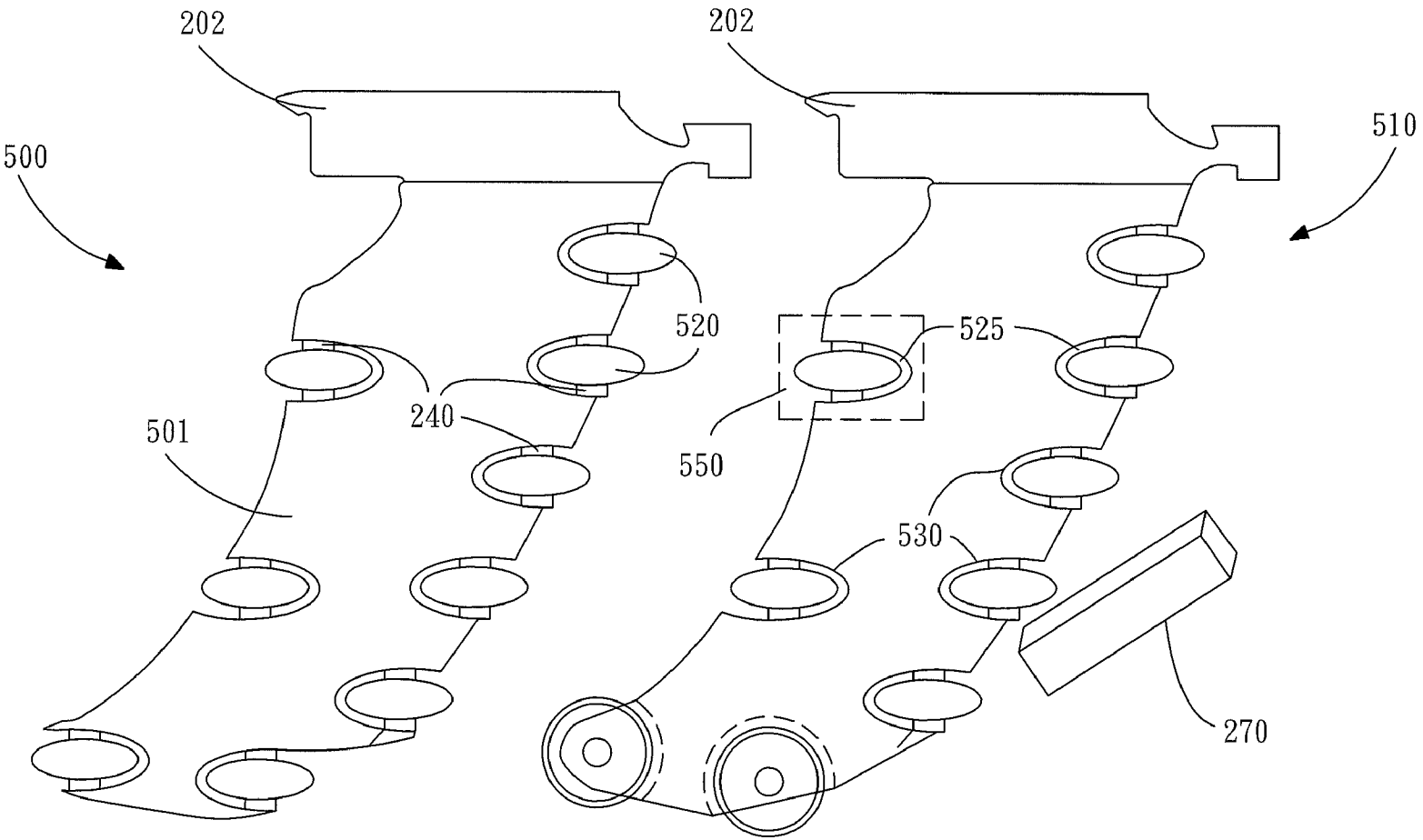
FIG. 5 is a schematic diagram illustrating a horizontal-roller type and a horizontal-and-vertical roller type fin.
Figure 6:
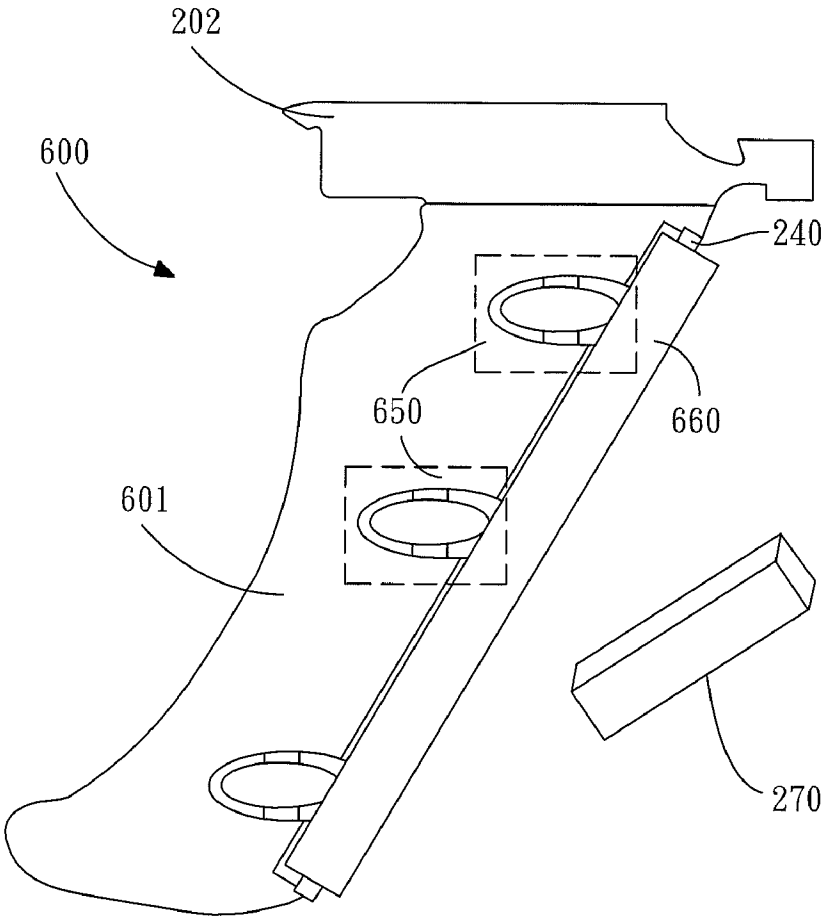
FIG. 6 is a schematic diagram illustrating a roller-cylinder type fin.
Figure 7:
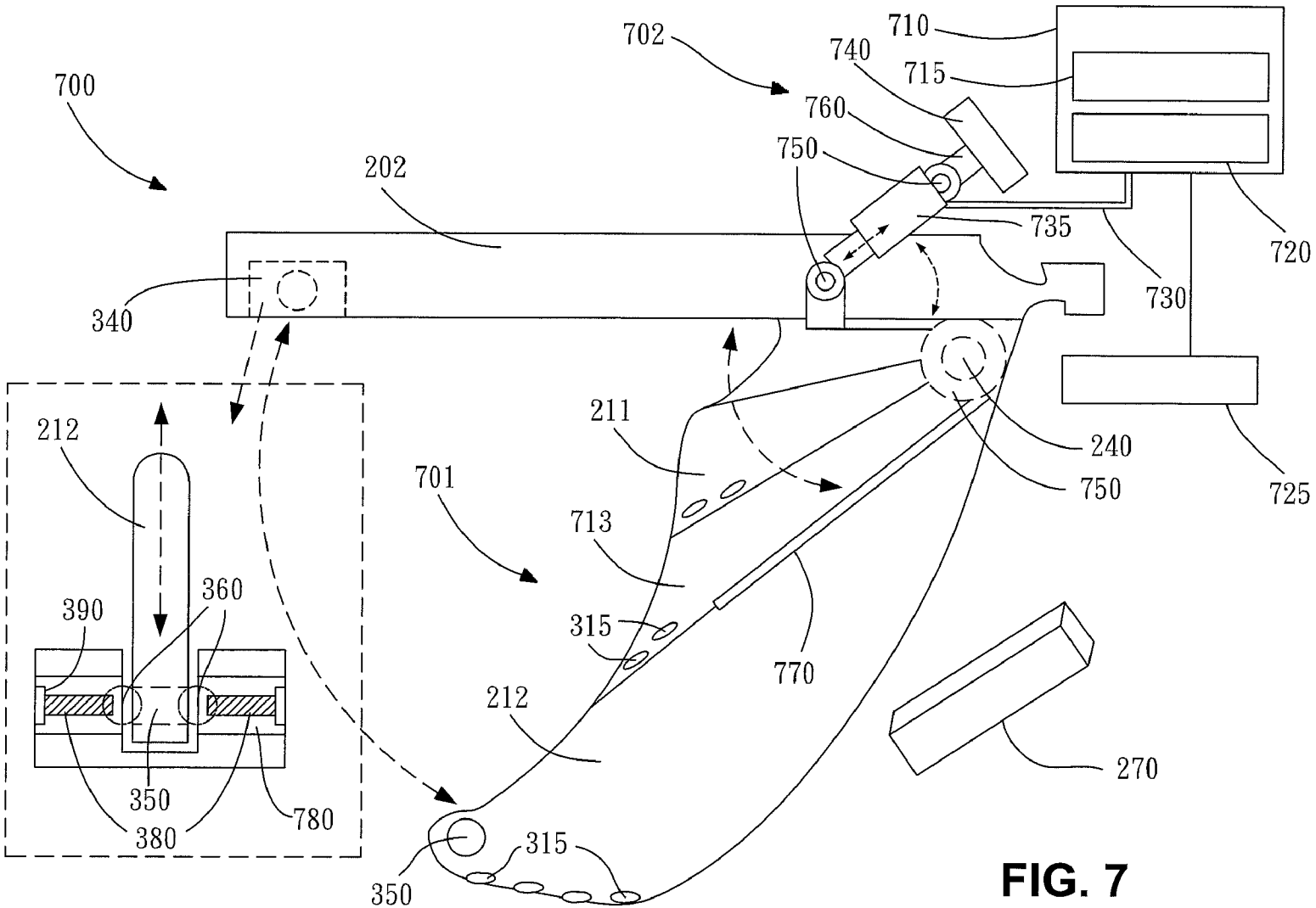
FIG. 7 is a schematic diagram illustrating a power-driven-retraction type fin.

Please refer to FIG. 5 to FIG. 7, in which four types of fins which provide protection against collision are also described, which are the horizontal-roller type fin 500, the horizontal-and-vertical-roller type fin 510, the roller-cylinder type fin 600, and the power-driven-retraction type fin 700.

Please refer to FIG. 5, in which the horizontal roller type fin 500 as well as the horizontal and vertical roller type fin 510 are illustrated. The horizontal roller type fin 500 has at least one fin plate 501 and at least one roller module 550, wherein the roller module 550 is arranged at the leading edge or the back edge of the fin plate 501.

The horizontal roller type fin 500 not only enables the surfboard 10 to change direction, but also keeps the balance of the surfboard 10. The fin plate 501 of the horizontal roller type fin 500 is installed beneath the surfboard 10 through the fin base 202. The fin base 202 which connects to the fin plate 501 is used to fix the fin plate 501 onto the surfboard 10. The roller trench 525 is provided for the installation of the roller module 550 on the fin plate 501. The foreign object 270 means anything which could be hit by the horizontal roller type fin 500, such as a human body, swimming tool, fish, or reef.

Due to the setup of the roller module 550, the foreign object 270 hits the roller 520 rather than the sharp edge, and the rotation of the roller 520 protects the foreign object 270 from harm. The outline of the roller 520 can be designed to be round and smooth and also can be produced from soft materials. The pivot 240 which passes through the center of the roller 520 is fixed to an appropriate position of the roller frame 530 so that the roller 520 can rotate free.

All of the roller modules 550 are horizontal and cross the fin plate 501 vertically.

The horizontal roller type fin 500 at least has one roller module 550 which is installed on the fin plate 501. The gap between each of the roller modules 550 depends on the design requirement. However the gap must be narrow enough to prevent the foreign object 270 being hit by the sharp edge of the horizontal roller type fin.

The fin plate 501 and the fin base 202 are made as either one piece or independent. The position of the roller trench 525 is arranged at where the roller module 550 is installed.

In order to increase production efficiency, the parts of the roller module 550 (including roller 520, roller frame 530, and pivot 240) can be produced and designed individually. The parts are subsequently collected, classified and assembled to a module. Finally, the roller module 550 is installed on the roller trench 525 of the fin plate 501.

Various material properties of the fin plate 501, fin base 202 and roller module 550 (including roller 520, roller frame 530, and pivot 240) should be considered, such as lightness, chemical resistance, wear resistance, impact resistance and UV resistance. It is suggested that the material can be selected from the group consisting of fiber reinforced plastics (FRP), light metal, rubber, and other light synthesized materials. The shape should also be taken into consideration. Streamline and safety are the basic requirements. Several methods can be used to create this invention, such as machining, module assembling, and molding.

The diameter of the roller 520 installed horizontally to the fin plate 501 is greater than the thickness of the fin plate 501; and the roller 520 installed vertically to the fin plate 501 is designed to be jutted out the edge of the fin plate 501, as shown in FIG. 5. Only then can the foreign objects (someone or something) 270 be protected from harm.

When an unfortunate accident occurs, the embodiment protects the foreign objects 270 by two means. One is preventing foreign objects 270 from being hit by the sharp edge of the fin plate 501, the other is making the foreign objects 270 slip away through the rotation of the roller 520.

In FIG. 5, the right side diagram illustrates the horizontal and vertical roller type fin 510 having at least on fin plate 501 and roller module 550.

At the leading edge of the fin plate 501, the roller modules 550 are installed horizontally and cross the fin plate 501 vertically.

Compared with the horizontal roller type fin 500, at the tail of the fin plate 501 of the horizontal and vertical roller type fin 510, the roller modules 550 are installed vertically.

The functions of the horizontal and vertical roller type fin 510 are basically the same as the description of horizontal roller type fin 500, so it is unnecessary to repeat the details.

Please refer to FIG. 6, in which the roller cylinder type fin 600 is illustrated. In this embodiment, a cylinder 660 having similar functions as the roller 520 does is also installed in front of the leading edge of the fin plate 601. In addition, at least one roller module 650 installed on the leading edge of the fin plate 601 is arranged behind the cylinder 660, which enhances the impact resistance of the cylinder 660.

In the embodiment, the diameter of the cylinder 660 should be greater than the thickness of the fin plate 601 so that the foreign object 270 can be protected.

The functions of the roller cylinder type fin 600 are basically the same as the description of the description of horizontal roller type fin 500, thus the details is not necessary to be given repeatedly.

Please refer to FIG. 7, in which the power-driven retraction type fin 700 is illustrated. Compared with the first embodiment, the power-driven retraction type fin 700 further includes a power-driven retraction device 702, which makes a fin module 701 (including the first retractable plate 211, second retractable plate 212, and a third retractable plate 713) can be retracted manually or electrically. Since retraction of the fin module 701 is either manual or electrical, the elastic component and the elastic component fixing hole are not necessary in this embodiment.

The detailed description of this embodiment is only focused on the power-driven retraction device 702, which has not been introduced. The power-driven retraction type fin 700 includes at least one fin base, the first retractable plate 211, the second retractable plate 212, the third retractable 713, the fin plate fixing unit 340, and the power-driven retraction device 702.

The power-driven retraction device 702 includes a retraction control module 710 which connects to the fin module 701. The retraction control module 710 consists of a manual control unit 715 and an automatic control unit 720, making user can manipulate the fin module 701 by the manual control unit 715 and the automatic control unit 720 alternatively. The manual control unit 715 provides the user with manipulating the retraction of the fin module 701 by itself. The automatic control unit 720 is electrically connected to an impact sensor 725 which is equipped at the bottom of the aquatic carrier. If the impact sensor 725 detects a foreign object 270 about to collide with the fin module 701, an alarm signal will be sent to the automatic control unit 720. Upon receiving the alarm signal from the impact sensor 725, the automatic control unit 720 will retract the fin module 701 immediately. Once the impact sensor 725 detects an absence of threat, a release signal will be sent from the impact sensor 725 to the automatic control unit 720, so that the fin module 701 will be released to the original position. The control line 730 is electrically connected the retraction control module 710 to a retraction component 735 which connects to the fin module 701. The retraction component 735 is used to retract or release the fin module 701 according to the retraction control module 710. The fixing base 740 fixes the retraction component 735 through a fixing rod 760. Each of the pivot holes 750 is passed through a pivot 240. One end of the fin rack 770 is connected to the second retractable plate 212 and the third retractable plate 713, and another end is connected to the retraction component 735. Hence, the retraction component 735 can retract the fin module 701 by pulling the fin rack 770 up and down.

In this embodiment, the fin module 701 can be manipulated either manually or automatically. In the mode of manual manipulation, the user determines when to retract or release the fin module 701. In the mode of automatic manipulation, the retraction and release of the fin module 701 are determined by the impact sensor 725. If the impact sensor 725 detects a foreign object 270 about to collide with the fin module 701, the fin module 701 will be retracted. The fin module 701 is released to the original position only if the impact sensor 725 detects nothing.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A fin of an aquatic carrier, comprising:

a fixing component;

a retractable component, pivoted to the fixing component and having at least a drain hole; and a first elastic component, connected to the fixing component and the retracted component, supporting the retractable component by elasticity;

wherein the retractable component compresses the first elastic component and rotates with respect to the fixing component when experiencing external force.

2. The fin of an aquatic carrier of claim 1, wherein the retractable component has a first hollow part, and the fixing component is contained in the first hollow part when the retractable component rotates with respect to the fixing component.

3. The fin of an aquatic carrier of claim 1, wherein the fixing component has a fin base.

4. The fin of an aquatic carrier of claim 1, wherein the retractable component comprises:

a first retractable plate, pivoted to the fixing component;

a second retractable plate, pivoted to the first retractable plate; and a second elastic component, connected to the first retractable plate and the second retractable plate, supporting the second retractable plate by elasticity;

wherein the second retractable plate compresses the second elastic component and rotates with respect to the first retractable plate when experiencing external force.

5. The fin of an aquatic carrier of claim 4, wherein the second retractable plate has a second hollow part, the first retractable plate is contained in the second hollow part when the retractable component rotates with respect to the fixing component.

6. An aquatic carrier, comprising:

a carrier component;

a fixing component;

a retractable component, pivoted to the fixing component and having at least a drain hole; and a first elastic component, connected to the fixing component and the retracted component, supporting the retractable component by elasticity;

wherein the retractable component compresses the first elastic component and rotates with respect to the fixing component when experiencing external force.

7. The aquatic carrier of claim 6, wherein the retractable component has a first hollow part, and the fixing component is contained in the first hollow part when the retractable component rotates with respect to the fixing component.

8. The aquatic carrier of claim 6, wherein the fixing component has a fin base.

9. The aquatic carrier of claim 6, wherein the retractable component comprises:

a first retractable plate, pivoted to the fixing component;

a second retractable plate, pivoted to the first retractable plate; and a second elastic component, connected to the first retractable plate and the second retractable plate, supporting the second retractable plate by elasticity;

wherein the second retractable plate compresses the second elastic component and rotates with respect to the first retractable plate when experiencing external force.

10. The aquatic carrier of claim 9, wherein the second retractable plate has a second hollow part, and the first retractable plate is contained in the second hollow part when the retractable component rotates with respect to the fixing component.

11. A fin of aquatic carrier, comprising:

a fixing component;

a retractable component, pivoted to the fixing component; and a first elastic component, connected to the fixing component and the retracted component, supporting the retractable component by elasticity, wherein the retractable component compresses the first elastic component and rotates with respect to the fixing component when experiencing external force, the retractable component includes:

a first retractable plate, pivoted to the fixing component;

a second retractable plate, pivoted to the first retractable plate; and a second elastic component, connected to the first retractable plate and the second retractable plate, supporting the second retractable plate by elasticity, and the second retractable plate includes the second elastic component and rotates with respect to the first retractable plate when experiencing external force.

12. The fin of aquatic carrier of claim 11, wherein the second retractable plate has a second hollow part, and the first retractable plate is contained in the second hollow part when the retractable component rotates with respect to the fixing component.

* * * * *